US005195441A

United States Patent [19]

Kay

[11] Patent Number: 5,195,441

[45] Date of Patent: Mar. 23, 1993

[54] DRAFTING TABLE

[75] Inventor: Charles Kay, Lakeland, Fla.

[73] Assignee: Log/Panel Systems, Inc., Madisonville, Tenn.

[21] Appl. No.: 750,187

[22] Filed: Aug. 26, 1991

[51] Int. Cl.[5] ..... A47B 3/06

[52] U.S. Cl. ..... 108/153; 108/25

[58] Field of Search ..... 108/153, 25; 312/231, 312/242; 211/10, 11, 45

[56] References Cited

U.S. PATENT DOCUMENTS

| | | | |
|---|---|---|---|
| 1,339,501 | 5/1920 | Dianisca | 108/25 |
| 1,975,524 | 10/1934 | Weisbrod | 108/25 |
| 2,240,395 | 4/1941 | Evans | 108/25 X |
| 2,584,039 | 1/1952 | Muff | 211/10 X |
| 2,675,288 | 4/1954 | Ushior | 312/231 X |
| 3,286,428 | 11/1966 | Kay . | |
| 3,574,253 | 4/1971 | Kay . | |
| 3,603,060 | 9/1971 | Kay . | |
| 3,663,080 | 5/1972 | Ayers | 312/242 X |
| 3,751,794 | 8/1973 | Kay . | |
| 3,804,316 | 4/1974 | Kay . | |
| 3,929,534 | 12/1975 | Kay . | |
| 4,179,033 | 12/1979 | Mitchell | 211/45 X |
| 4,212,564 | 7/1980 | Kay . | |
| 4,352,597 | 10/1982 | Kay . | |

FOREIGN PATENT DOCUMENTS

| | | | |
|---|---|---|---|
| 1423107 | 1/1966 | France | 312/231 |

*Primary Examiner*—Jose V. Chen

*Attorney, Agent, or Firm*—Price, Heneveld, Cooper, DeWitt & Litton

[57] ABSTRACT

A table, particularly an architect's table, having a top and a pair of upright pedestals beneath the top, the top being formed of a pair of vertically spaced panels interconnected by a plurality of metal splines embedded in the panels, and the pedestals each being formed of a pair of laterally spaced panels interconnected by a plurality of metal splines embedded in these panels, the panels and splines of the top and of the pedestals forming elongated pigeonhole cavities to receive and store rolled drawings.

6 Claims, 1 Drawing Sheet

DRAFTING TABLE

BACKGROUND OF THE INVENTION

This invention relates to working tables or desks as for architects, draftsmen and the like.

Architects, draftsmen and others who work with large drawings and charts frequently have the need to spread out such documents for examination. This is normally done on large surfaces of tables or desks. The originals of such documents are typically stored in elongated shallow drawers in cabinets, with work copies being made for examination, rough marking and modification. When such drawings are to be marked up, it is normally desirable to have a series of them readily available at the work surface rather than storing them in files, since sequential examination and re-examination of several related work drawings is common. At present, the drawings are often simply shoved to the side, piled on the floor, and sometimes even placed back in the file drawers All of these techniques result in inefficient use of time. Casual placement of the drawings on the floor or other surfaces can result in damage to the drawings, loss of drawings, or the like.

SUMMARY OF THE INVENTION

An object of this invention is to provide an architect's table or desk which enables large documents such as work copies of drawings to be kept immediately at hand, in organized fashion, using the table itself for temporary storage, while also providing a structurally sturdy, lightweight, relatively inexpensive table. The documents can be stored in elongated pigeonholes formed by the structural components of the table. The table has a special top and pair of pedestals.

Another object of this invention is to provide an architect's table capable of quick, inexpensive fabrication, and defining elongated pigeonhole chambers to receive rolled sheets of drawings.

The novel table has an elongated top formed of a pair of vertically spaced upper and lower panels secured together by splines having flanges embedded in the panels. The splines are spaced from each other and, with the panels, define the elongated pigeonholes. Each of the pedestals has a pair of laterally spaced inner and outer panels secured together by splines having flanges embedded in these panels. The splines and panels define elongated pigeonholes therebetween, open at least at one end thereof to enable rolled up documents such as drawings to be readily inserted and removed as desired.

These and other features, objects and advantages of the invention will become apparent upon studying the following specification in conjunction with the drawings.

DESCRIPTION OF THE PREFERRED EMBODIMENT

Referring now specifically to the drawings, the architect's table 10 is shown to include an elongated top 12 and a pair of upright, laterally spaced pedestals 14 mounted to the top and supporting it above a support surface such as a floor.

The terms front and rear will be employed herein relative to top 12 and to pedestals 14. These terms are for explanation only, since clearly either edge could be termed the front edge or the rear edge.

Figure 4:
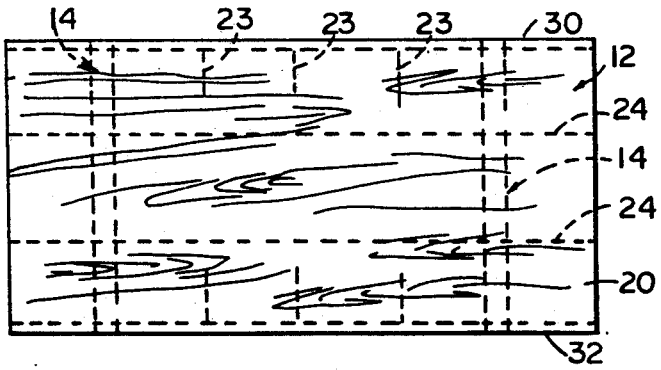
FIG. 4 is a top plan view of the table.
Figure 5:
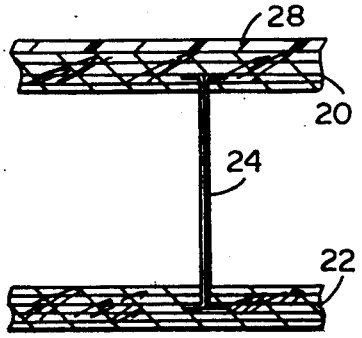
FIG. 5 is a fragmentary elevational view of a portion of the top.
Figure 6:
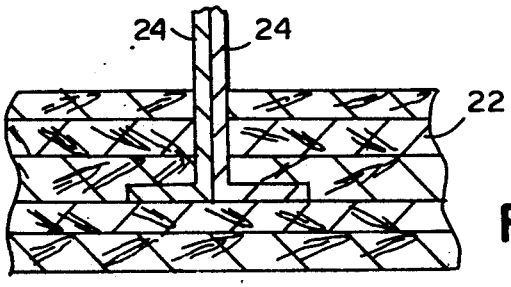
FIG. 6 is a fragmentary sectional view of one edge of the splines shown embedded in a plywood panel.

Top 12 is preferably elongated in its dimension parallel to the front and rear edges, i.e., normal to the dimension between the front and rear edges 16 and 18. Top 2 comprises an upper panel 20 and a lower panel 22 vertically spaced beneath upper panel 20. Each of these panels is preferably made of multilayered plywood such as three-quarter inch plywood. The upper surface of upper panel 20 comprises a dress surface 28 (FIG. 5) which may be coated, laminated, or otherwise applied. These two panels are spaced in parallel relationship a controlled amount from each other, preferably the width of a standard two-by-four, i.e., three and five-eighths inches. They are secured together by a plurality of elongated splines 24, preferably of metal. Each of these splines has a cross section which includes a central planar body portion and a pair of edge flanges running substantially the length of the spline, normal to the planar body portion. The splines are relatively thin, about one-sixteenth of an inch thickness, usually of metal, preferably steel. Pairs of these splines are positioned back-to-back at spaced intervals across the breadth of the tabletop from the front edge to the rear edge. At the respective front and rear edges of top 12 are a front edge member 30 and a rear edge member 32 of conventional wood two-by-four stock, each being flush with the edges of panels 20 and 22. These are anchored in place by fasteners, adhesive, or a combination thereof. Splines 24 have their flanges and the adjacent portions of the body embedded into panels 20 and 22. This is done forcefully by ramming the panels lengthwise using apparatus, for example, such as that shown in U.S. Pat. No. 3,714,696. Shorter length splines 23 (FIG. 4) are shown arranged transverse to elongated splines 24, along the length of top 12. These provide added stability.

Figure 1:
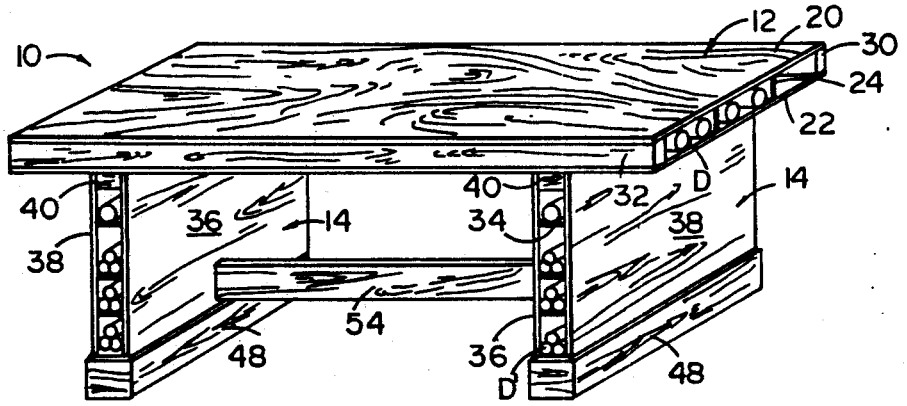
FIG. 1 is a perspective view of the novel architect's table of this invention.

The spaced splines 24, along with panels 20 and 22, define a plurality of elongated pigeonhole cavities capable of receiving rolled up documents such as drawings, charts, blueprints or the like, as depicted by drawings D in FIG. 1. In the depicted embodiment, the pigeonhole cavities extend lengthwise of the top.

Each of the pedestals 14 comprises a pair of inner and outer panels 36 and 38, normally of plywood, interconnected and held in the spaced parallel relationship to each other a few inches apart by a plurality of splines 34, each of which has transverse end flanges embedded in the panels comparable to splines 24. The pedestals are positioned transversely to the elongated dimension of top 12, i.e., extending from front to rear of the table. The splines are normally of metal, preferably steel, and have the flanges and the adjacent portions of the body of the flange forcefully embedded into panels 36 and 38 over the length of the panels. These splines and panels define a plurality of vertically spaced, elongated pigeonholes into which rolled up drawings D' or the like can be placed for handy storage. These pigeonholes are left open at least at one end thereof for ready insertion and removal of the rolled up documents. Between panels 36 and 38, at the upper edge thereof, is a top edge member 40. Between the lower ends of panels 36 and 38 is a bottom edge member 42. These edge members may be conventional two-by-four elements fastened between the panels by adhesion, fasteners, or a combination thereof. Around the bottom portion of each pedestal 14 is a jacket-type foot 48 of suitable material such as a molded polymer, wood or the like, for protection of the pedestal base and for dress purposes. The outer faces of inner and outer panels 36 and 38 have dress surfaces for aesthetic appeal.

Extending between pedestals 14 above the bottom edges thereof and below the bottom panel 22 of top 12 is an elongated brace 54 fastened to the pedestals as by threaded fasteners or the equivalent.

Figure 2:
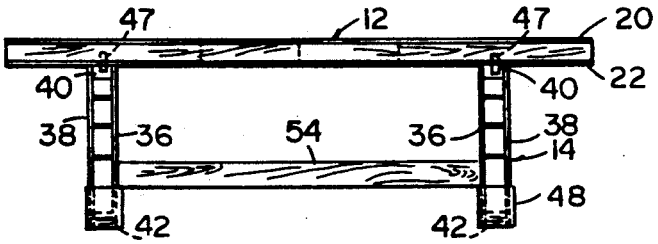
FIG. 2 is a front elevational view of the table.
Figure 3:
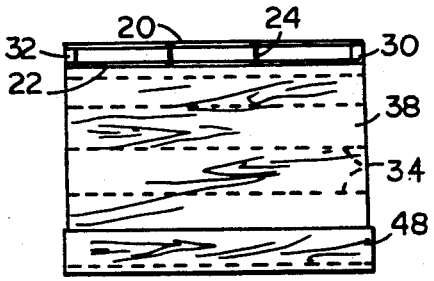
FIG. 3 is an end elevational view of the table.

Pedestals 14 are secured to top 12 by suitable fasteners 47 (FIG. 2), adhesion, or both, preferably extending the fasteners through upper edge members 40 and front and rear edge members 30 and 32.

The resulting structure is strong and sturdy, yet lightweight and attractive. The table is particularly handy to employ since drawings can be readily inserted and removed from the pedestals or the tabletop while working with them, allowing the documents to be properly stored and protected, yet completely available immediately as necessary.

Various minor modifications in the construction will likely occur to those in the furniture art upon studying this above description of the preferred embodiment of the invention. The invention is not intended to be limited specifically to the preferred embodiment disclosed as illustrative, but only by the scope of the appended claims and the reasonably equivalent structures to those defined therein.

The embodiments of the invention in which an exclusive property or privilege is claimed are defined as follows.

1. An architect's table comprising:

an elongated top having front and rear edges and opposite ends, comprising a pair of vertically spaced upper and lower panels, a first plurality of elongated splines between said panels extending between said opposite ends of said top, and having flanges embedded in both said panels; said vertically spaced panels and said first plurality of splines defining first elongated pigeonhole cavities with open ends facing at least one of a front edge, rear edge, or an end;

a pair of elongated edge members between said panels along said front and rear edges;

said upper panel having an upper dress surface;

a pair of upright pedestals oriented transversely of said elongated top, spaced from each other, positioned beneath said top, each said pedestal having a pair,. of laterally spaced parallel panels and a second plurality of elongated splines between said panels with flanges embedded in said panels;

each said pedestal having an elongated top edge member between the upper ends of said laterally spaced panels and abutting said lower panel of said top, and having an elongated bottom edge member between the lower ends of said laterally spaced panels;

said laterally spaced panels and said second plurality of splines defining second elongated pigeonhole cavities with open ends facing at least the rear of said table;

fastener means between said top edge members and said bottom panel of said top for fastening said pedestals to said top; and an elongated connector between said pedestals having its ends secured to said pedestals and located between the bottom of said pedestals and the bottom of said top.

2. The architect's table in claim 1 wherein said pedestals each include a lower portion and a foot jacket around said lower portion.

3. A table or desk comprising:

an elongated top having front and rear edges and opposite ends, comprising a pair of vertically spaced upper and lower panels, a first plurality of elongated splines between said panels, and having flanges embedded in both said panels;

elongated edge members between said panels;

said upper panel having an upper dress surface;

a pair of upright pedestals oriented transversely of said elongated top, spaced from each other, positioned beneath said top, each said pedestal having a pair of laterally spaced parallel panels and elongated splines between said panels said vertically spaced panels and said first plurality of splines defining first elongated pigeonhole cavities with open ends facing at least one of a front edge, rear edge or an end with flanges embedded in said panels;

each said pedestal having an elongated top edge member between the upper ends of said laterally spaced panels and abutting said lower panel of said top, and having an elongated bottom edge member between the lower ends of said laterally spaced panels;

said laterally spaced panels and a second plurality of splines defining second elongated pigeonhole cavities;

said pedestals being fastened to said top.

4. The table or desk in claim 3 wherein said splines in said top are arranged in back-to-back pairs.

5. The table or desk in claim 3 wherein said splines in said top extend lengthwise between said opposite ends of said top.

6. The table or desk in claim 5 including an elongated connector between said pedestals, below said top.

* * * * *